US007044894B1

(12) United States Patent
Smith

(10) Patent No.: US 7,044,894 B1
(45) Date of Patent: May 16, 2006

(54) EXERCISE DEVICE AND METHOD

(76) Inventor: Tamilla R. Smith, 1010 E. Woodrow Ave., Lombard, IL (US) 60148

( * ) Notice: Subject to any disclaimer, the term of this patent is extended or adjusted under 35 U.S.C. 154(b) by 257 days.

(21) Appl. No.: 10/661,073

(22) Filed: Sep. 13, 2003

(51) Int. Cl.
*A63B 71/00* (2006.01)

(52) U.S. Cl. ..... 482/74; 482/124; 482/121

(58) Field of Classification Search ..... 482/74, 482/121–129, 907, 148
See application file for complete search history.

(56) References Cited

U.S. PATENT DOCUMENTS 2,118,114 A * 5/1938 Schenk ..... 482/126
2,590,951 A * 4/1952 Farison ..... 482/126
4,023,808 A * 5/1977 Hebert ..... 482/126
4,911,439 A * 3/1990 Kuhl ..... 482/124
5,318,494 A * 6/1994 Santighian ..... 482/125
5,518,481 A * 5/1996 Darkwah ..... 482/126

* cited by examiner

*Primary Examiner*—Jerome W. Donnelly

(57) ABSTRACT

A new and improved figure eight shaped exercise device and method of using is disclosed. One preferred embodiment of the device comprises a first hoop-like member having a handgrip attached to the first hoop-like member 12 and a second hoop-like member attached to the first hoop-like member. Another preferred embodiment of the device consist of a first hoop-like member having a handgrip attached to the first hoop-like member; and a second hoop-like member attached to the first hoop-like member, the second hoop-like member having an arm engagement pad. One preferred embodiment of the method comprises the steps of adjusting, gripping, inserting, jogging, obtaining, running, slipping, suspending, and walking.

1 Claim, 2 Drawing Sheets

EXERCISE DEVICE AND METHOD

FIELD OF THE INVENTION

The present invention relates to exercise equipment, more particularly, to a figure eight shaped exercise device for use in suspending a user's arm while walking or jogging.

DESCRIPTION OF THE PRIOR ART

During the exercise modes of walking, jogging, or running may produce considerable discomfort associated with the user's arms. Even while walking, an exerciser may develop muscle fatigue in the exerciser's arms, upper back and lower neck regions corresponding to prolonged exertion of suspending the exerciser's arms in an improper alignment.

A wide variety of exercise devices is currently available on the commercial market and an even larger number of these types of devices are known in the art of exercise devices, for example, the body attached elastic type exercising device disclosed by Hopkins, Jr. in U.S. Pat. No. 4,540,173; the coordinated arm-leg aerobic walking exercise device disclosed by Wilkinson in U.S. Pat. No. 5,176,377; the jobbing and walking exercise device and method of use thereof disclosed by Segarra in U.S. Pat. No. 5,529,556; the exercise device disclosed by Pape in U.S. Pat. No. 5,683,336; and the finger exerciser disclosed by McCraw in U.S. Pat. No. D445,856.

While all of the above-described devices fulfill their respective, particular objectives and requirements, the aforementioned patents do not describe an exercise device having a first hoop-like member having a handgrip attached to the first hoop-like member and a second hoop-like member attached to the first hoop-like member. This combination of elements would specifically match the user's particular individual needs by making it possible to allow a user to comfortably suspend a user's arm in a bent position between about 35 degrees to 150 degrees while wearing the device during walking, jogging and running exercise. The above-described patents make no provision for an exercise device having a first hoop-like member having a handgrip attached to the first hoop-like member and a second hoop-like member attached to the first hoop-like member.

Therefore, a need exists for a new and improved exercise device having a first hoop-like member having a handgrip attached to the first hoop-like member and a second hoop-like member attached to the first hoop-like member. In this respect, the exercise device according to the present invention substantially departs from the conventional concepts and designs of the prior art, and in doing so provides an apparatus primarily developed for the purpose of allowing a user to suspend a user's arm in a bent position between about 35 degrees to 150 degrees while wearing the device during walking, jogging and running exercise.

SUMMARY OF THE INVENTION

The present device and method, according to the principles of the present invention, overcomes the shortcomings of the prior art by providing a new and improved figure eight shaped exercise device and method. One preferred embodiment of the device comprises a first hoop-like member having a handgrip attached to the first hoop-like member and a second hoop-like member attached to the first hoop-like member. Another preferred embodiment of the device consist of a first hoop-like member having a handgrip attached to the first hoop-like member; and a second hoop-like member attached to the first hoop-like member, the second hoop-like member having an arm engagement pad. One preferred embodiment of the method comprises the steps of adjusting, gripping, inserting, jogging, obtaining, running, slipping, suspending, and walking.

In view of the foregoing disadvantages inherent in the known type exercise devices now present in the prior art, the present invention provides an improved exercise device, which will be described subsequently in great detail, is to provide a new and improved exercise device which is not anticipated, rendered obvious, suggested, or even implied by the prior art, either alone or in any combination thereof.

To attain this, the present invention essentially comprises a first hoop-like member having a handgrip attached to the first hoop-like member and a second hoop-like member attached to the first hoop-like member.

There has thus been outlined, rather broadly, the more important features of the invention in order that the detailed description thereof that follows may be better understood, and in order that the present contribution of the art may be better appreciated.

The invention may also include an optional arm engagement pad for evenly dispersing the force exerted by suspending the lower arm to the rear section of the upper arm of the user. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise device that has all the advantages of the prior art exercise device and none of the disadvantages.

It is another object of the present invention to provide a new and improved exercise device that may be easily and efficiently manufactured and marketed.

An even further object of the present invention is to provide a new and improved exercise device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new exercise device that provides in the apparatuses and methods of the prior art some of the advantages thereof, while simultaneously overcoming some of the disadvantages normally associated therewith.

Even still another object of the present invention is to provide a exercise device having a first hoop-like member having a handgrip attached to the first hoop-like member and a second hoop-like member attached to the first hoop-like member. This combination of elements makes it possible to allow a user to suspend a user's arm in a bent position between about 35 degrees to 150 degrees while wearing the device during walking, jogging and running exercise.

Lastly, it is an object of the present invention to provide a new and improved method comprises the steps of adjusting, gripping, inserting, jogging, obtaining, running, slipping, suspending, and walking.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
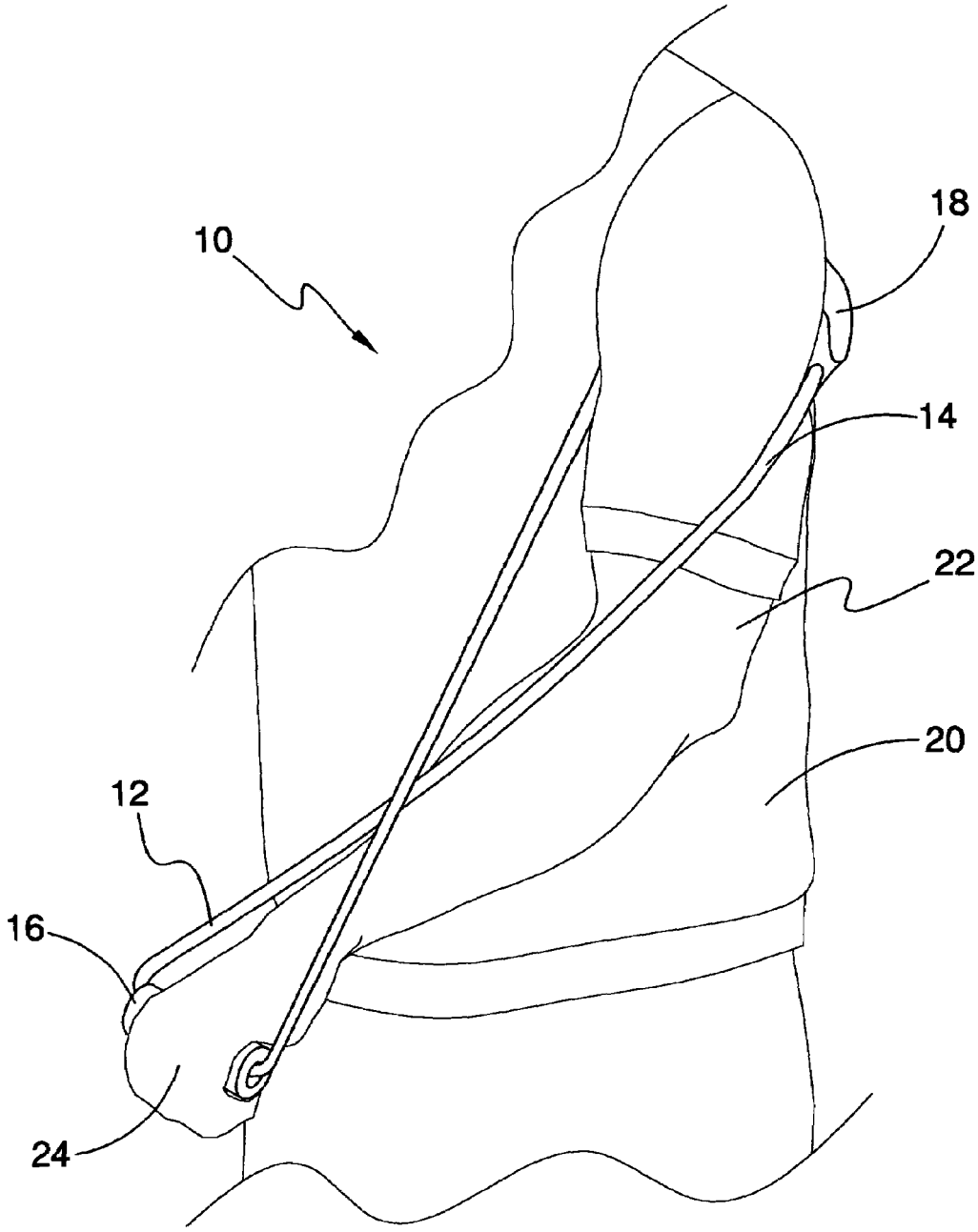
FIG. 1 is a perspective view of a preferred embodiment of the exercise device worn by a user constructed in accordance with the principles of the present invention.
Figure 2:
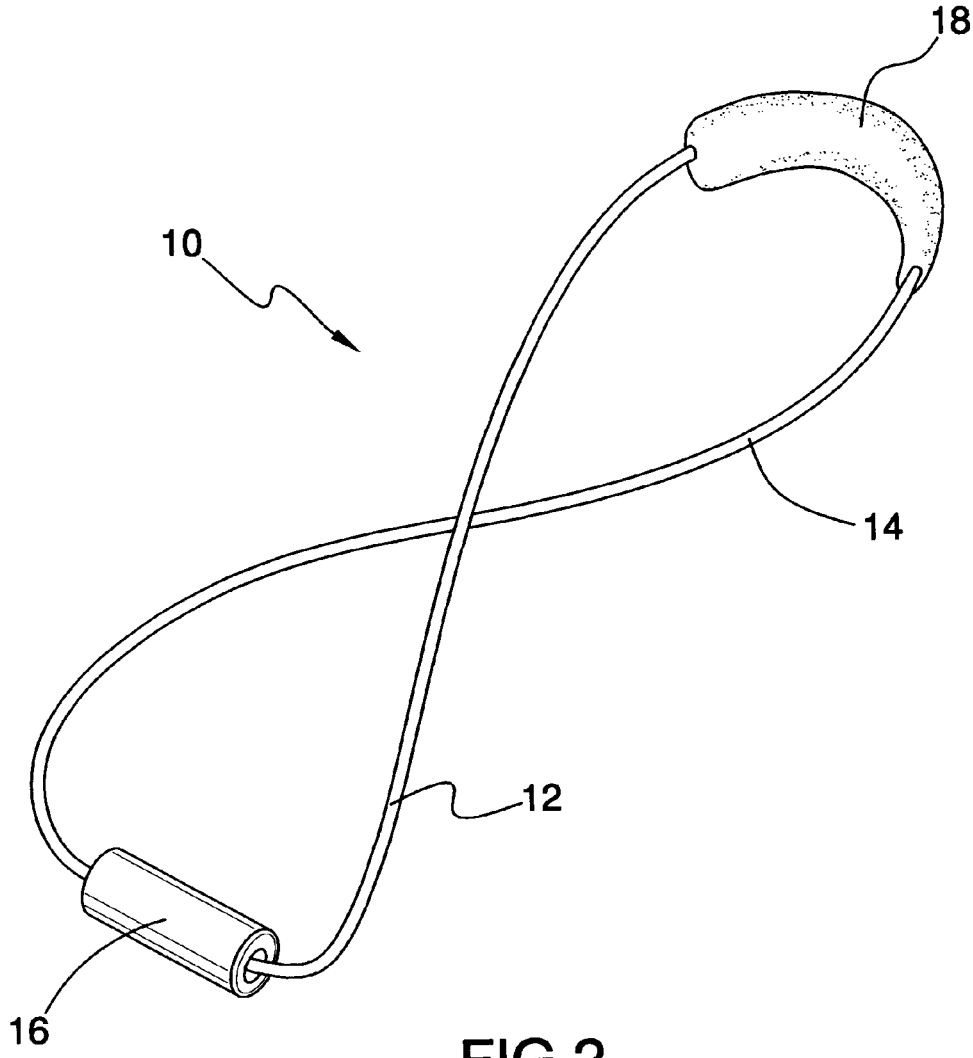
FIG. 2 is a perspective view of a preferred embodiment of the exercise device of the present invention.

Referring now to the drawings, and in particular FIG. 1 to 2 thereof, one preferred embodiment of the present invention is shown and generally designated by the reference numeral 10. One preferred embodiment of the figure eight shaped exercise device 10 comprises a first hoop-like member 12 having a handgrip 16 attached to the first hoop-like member 12; and a second hoop-like member 14 attached to the first hoop-like member 12.

Another preferred embodiment of the figure eight shaped exercise device 10 consist of: a first hoop-like member 12 having a handgrip 16 attached to the first hoop-like member 12; and a second hoop-like member 14 attached to the first hoop-like member 12, the second hoop-like member 14 having an arm engagement pad 18.

The handgrip 16 may be rigidly affixed or rotatively attached to the first hoop-like member 12. The handgrip 16 may be made of any commercially available material as long as it is capable of being held by a user's 20 hand 24. One preferred configuration of the handgrip 16 is that it is made of foam rubber. Another preferred configuration of the handgrip 16 is that it is made of wood is selected from the group consisting of oak, pine, ash, poplar, elm, maple, black locust, fir, and cedar. Yet another preferred configuration of the handgrip 16 is that it is made of plastic.selected from the group consisting of polyurethanes, polyacryls, polymethacryls, cellulosic polymers, styrene-acryl copolymers, polystyrene-polyacryl mixtures, polysiloxanes, polyesters, urethane-acryl copolymers, siloxane-urethane copolymers, polyurethane-polymethacryl mixtures, silicone-acryl copolymers, vinyl acetate polymers, and mixtures thereof. Yet another preferred configuration of the handgrip 16 is that it is made of metal selected from the group consisting of aluminum, tin, copper, iron, nickel, manganese, titanium, carbon steel, galvanized steel, brass, bronze and mixtures thereof. Still another preferred configuration of the handgrip 16 is that it is has a mass of at least one pound. Even yet another preferred configuration of the handgrip 16 is that it is made of leather.

The first and second hoop-like members (12 and 14) may be made of any commercially available material as long as they are able to support the weight of the user's 20 arm 22. One preferred configuration of the first and second hoop-like members (12 and 14) is that they are made of a stretch fiber clothe material. Another preferred configuration of the first and second hoop-like members (12 and 14) is that they are made of fabric selected from the group consisting of cotton, wool, nylon, polyester, polypropylene, polyurethane, and admixtures thereof. Yet preferred configuration of the first and second hoop-like members (12 and 14) is that they reflect at least 20% of the incident light shone on the first and second hoop-like members (12 and 14). Still preferred configuration of the first and second hoop-like members (12 and 14) is that they fluoresce, thereby the first and second hoop-like members (12 and 14) are capable of glowing at night.

The arm engagement pad 18 may be rigidly affixed or slidably attached to the second hoop-like member 14. The arm engagement pad 18 may be made of any commercially available material as long as it is able to be conformed to wrap around a portion of the rear section of the upper arm 22 of a user 20. One preferred configuration of the arm engagement pad 18 is that it is made of leather. Another preferred configuration of the arm engagement pad 18 is that it is made of foam rubber. Yet another preferred configuration of the arm engagement pad 18 is that it is made of plastic selected from the group consisting of polyurethanes, polyacryls, polymethacryls, cellulosic polymers, styrene-acryl copolymers, polystyrene-polyacryl mixtures, polysiloxanes, polyesters, urethane-acryl copolymers, siloxane-urethane copolymers, polyurethane-polymethacryl mixtures, silicone-acryl copolymers, vinyl acetate polymers, and mixtures thereof.

An optional arm engagement pad 18 may be added to the device 10. The arm engagement pad 18 is attached to the second hoop-like member 14.

One preferred embodiment of the method of using a figure eight shaped exercise device 10 comprises the steps of adjusting, gripping, inserting, jogging, obtaining, running, slipping, suspending, and walking. The obtaining step comprises obtaining the figure eight shaped exercise device 10 consisting of a first hoop-like member 12 having a handgrip 16 attached to the first hoop-like member 12; and a second hoop-like member 14 attached to the first hoop-like member 12, the second hoop-like member 14 having an arm engagement pad 18. The inserting step comprises inserting a user's 20 arm 22 through the second hoop-like member 14 of the device 10 until the upper section of the user's 20 arm 22 is positioned within the second hoop-like member 14 of the device 10. The slipping s step comprises slipping the lower section of the user's 20 arm 22 through the first hoop-like member 12 of the device 10. The adjusting step comprises adjusting the arm engagement pad 18 of the device 10 around the back portion of the upper section of the user's 20 arm. The gripping step comprises gripping the handgrip 16 of the device 10 with the hand of the user's 20 arm, wherein the steps of inserting, clipping, adjusting and gripping steps constitute wearing the device 10. The suspending step comprises suspending the user's 20 arm 22 bent at an angle between about 35 degrees to 150 degrees while wearing the device 10. The walking step comprises walking while wearing the device 10. The jogging step comprises jogging while wearing the device 10. The running step comprises running while wearing the device 10.

Referring now to FIG. 1 which depicts a perspective view of a preferred embodiment of the exercise device 10 worn by a user 20 showing a first hoop-like member 12 having a handgrip 16 attached to the first hoop-like member 12; and a second hoop-like member 14 attached to the first hoop-like member 12, the second hoop-like member 14 having an arm engagement pad 18. The arm 22 of the user 20 is shown engaging the device 10 so that the arm 22 may be suspended in a bent angle of about 35 degrees to 150 degrees while wearing the device.

Refer now to FIG. 2, which depicts a perspective view of a preferred embodiment of the exercise device 10 showing a first hoop-like member 12 having a handgrip 16 attached to the first hoop-like member 12; and a second hoop-like member 14 attached to the first hoop-like member 12, the second hoop-like member 14 having an arm engagement pad 18.

As to the manner of usage and operation of the present invention, the same should be apparent from the above description. Accordingly, no further discussion relating to the manner of usage and operation will be provided.

While a preferred embodiment of the exercise device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or comprising" or the term "includes or variations, thereof, or the them "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combination any two or more of the steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method of using a figure-eight-shaped exercise device, said method consisting of:

obtaining an oval band comprising a handgrip and an arm engagement member thereon; twisting said band into a figure-eight-shaped exercise device consisting of:

a first section having said handgrip; and a second section having said arm engagement pad;

inserting a user's arm through the second section of the device until the user's upper arm is positioned within the second section;

slipping the user's lower arm through the first section;

adjusting the arm engagement pad of the device around the back portion of the user's upper arm;

gripping the handgrip of the device with the hand of the user's arm, wherein the steps of inserting, clipping, adjusting and gripping steps constitute wearing the device;

suspending the user's arm bent at an angle between about 35 degrees to 150 degrees while wearing the device;

walking while wearing the device;

jogging while wearing the device; and running while wearing the device.

* * * * *